US011650521B2

(12) United States Patent
Toyota

(10) Patent No.: US 11,650,521 B2
(45) Date of Patent: May 16, 2023

(54) DEVELOPING DEVICE AND IMAGE FORMING APPARATUS INCLUDING THE SAME

(71) Applicant: KYOCERA Document Solutions Inc., Osaka (JP)

(72) Inventor: Yuji Toyota, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/861,130

(22) Filed: Jul. 8, 2022

(65) Prior Publication Data

US 2023/0022854 A1 Jan. 26, 2023

(30) Foreign Application Priority Data

Jul. 14, 2021 (JP) ..... JP2021-116249

(51) Int. Cl.
*G03G 15/08* (2006.01)

(52) U.S. Cl.
CPC . *G03G 15/0889* (2013.01); *G03G 2215/0819* (2013.01)

(58) Field of Classification Search
CPC ..... G03G 15/0855; G03G 15/0865; G03G 15/0889; G03G 15/0891; G03G 15/095; G03G 2215/0819; G03G 2215/083; G03G 2215/0833
See application file for complete search history.

(56) References Cited

U.S. PATENT DOCUMENTS

2008/0025763 A1 1/2008 Suenami ..... 399/256
2015/0132027 A1* 5/2015 Kashimoto ..... G03G 15/0877 399/254
2018/0253033 A1* 9/2018 Fujishima ..... G03G 15/0893

FOREIGN PATENT DOCUMENTS

JP 2008-33109 A 2/2008
JP 2018-146695 A 9/2018

* cited by examiner

*Primary Examiner* — Hoang X Ngo
(74) *Attorney, Agent, or Firm* — Stein IP, LLC

(57) ABSTRACT

A developing device includes a developing container, a first stirring conveyance member, a second stirring conveyance member, a developer carrying member, a toner concentration sensor, and a scraper. The first stirring conveyance member includes a rotary shaft, a first conveyance blade that is formed on an outer circumferential surface of the rotary shaft and conveys a developer in a first direction, and a second conveyance blade that has the opposite phase to the first conveyance blade and has a lower radial height than the first conveyance blade. The scraper is arranged substantially parallel to the rotary shaft at a position shifted in an axial direction from intersections between the first conveyance blade and the second conveyance blade and has a phase of 45° to 135° with respect to the closest one of the intersections on an upstream side in the first direction.

9 Claims, 4 Drawing Sheets

DEVELOPING DEVICE AND IMAGE FORMING APPARATUS INCLUDING THE SAME

INCORPORATION BY REFERENCE

This application is based upon and claims the benefit of priority from the corresponding Japanese Patent Application No. 2021-116249 (filed on Jul. 14, 2021), the entire contents of which are incorporated herein by reference.

BACKGROUND

The present disclosure relates to a developing device that is used in an image forming apparatus employing electrophotography, such as a copy machine, a printer, a facsimile, or a multi-functional peripheral having functions thereof, and also to an image forming apparatus incorporating such a developing device. The present disclosure relates particularly to a developing device that uses a two-component developer containing toner and carrier, and to an image forming apparatus incorporating the same.

In an image forming apparatus, a latent image formed on an image carrying member such as a photosensitive drum is developed by a developing device into a visible toner image. One type of such a developing device employs a two-component development method using a two-component developer. In this type of developing device, a two-component developer (hereinafter also referred to simply as developer) containing toner and carrier is stored in a developing container, a developing roller that supplies the developer to an image carrying member is arranged, and a stirring conveyance member that supplies, while stirring and conveying, the developer in the developing container to the developing roller is provided.

In a developing device employing the two-component development method, to supply as much toner as has been consumed in development, it is necessary to measure the toner concentration in the developer with a toner concentration sensor arranged in the developing container. For example, in one proposed developing device, the toner concentration sensor is arranged in a circulation path for the developer, at that side of it at which the developer is supplied to the developing roller and a toner supplying portion is arranged at the side at which the developer is not supplied to the developing roller. With this construction, the supplied toner is sufficiently stirred together with the developer in the developing container before reaching the toner concentration sensor, and the toner concentration in the developer can be sensed directly at the place where it is supplied to the developing roller. This leads to improved toner supply accuracy.

And according to one known method, to maintain the sensitivity of the toner concentration sensor, a scraper for cleaning the sensor surface (sensing surface) is attached to a part of a stirring conveyance member that faces the toner concentration sensor.

SUMMARY

According to one aspect of the present disclosure, a developing device includes a developing container, a first stirring conveyance member, a second stirring conveyance member, a developer carrying member, a toner concentration sensor, and a scraper. The developing container includes a plurality of conveyance chambers including a first conveyance chamber and a second conveyance chamber that are arranged mutually side by side, a partition wall that divides the first conveyance chamber and the second conveyance chamber from each other along a longitudinal direction, and a communication portion that establishes communication between the first conveyance chamber and the second conveyance chamber on both end sides of the partition wall, and contains a two-component developer including a carrier and a toner. The first stirring conveyance member stirs and conveys the developer present in the first conveyance chamber in a first direction. The second stirring conveyance member stirs and conveys the developer present in the second conveyance chamber in a second direction opposite to the first direction. The developer carrying member is rotatably supported to the developing container and carries, on a surface thereof, the developer present in the second conveyance chamber. The toner concentration sensor is arranged on an inner wall surface of the first conveyance chamber and senses a toner concentration in the developer. The scraper is fitted to the first stirring conveyance member and rotates together with the first stirring conveyance member so as to move the developer in a vicinity of the toner concentration sensor. The first stirring conveyance member includes a rotary shaft that is rotatably supported in the developing container, a first conveyance blade that is formed on an outer circumferential surface of the rotary shaft and is caused by rotation of the rotary shaft to convey the developer in the first direction, and a second conveyance blade that is formed on the outer circumferential surface of the rotary shaft so as to overlap with a region in which the first conveyance blade is formed, has the opposite phase to the first conveyance blade, and has a lower radial height than the first conveyance blade. The scraper is arranged substantially parallel to the rotary shaft at a position shifted in an axial direction from intersections between the first conveyance blade and the second conveyance blade, and the scraper has a phase of 45° to 135° with respect to the closest one of the intersections on an upstream side in the first direction.

DETAILED DESCRIPTION

Figure 1:
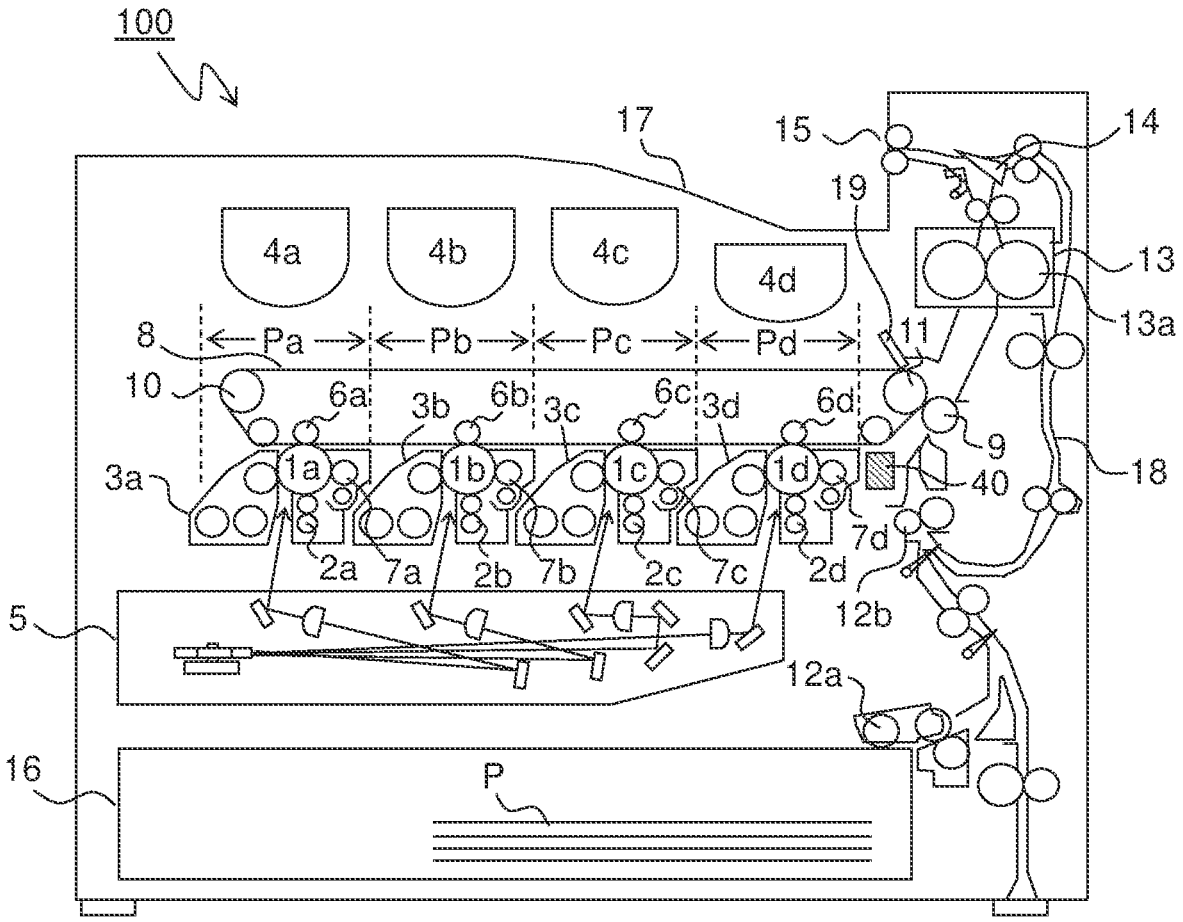
FIG. 1 is a schematic sectional view of an image forming apparatus mounted with a developing device according to the present disclosure.

With reference to the appended drawings, the following describes an embodiment of the present disclosure. FIG. 1 is a sectional view showing an internal structure of an image forming apparatus 100 according to one embodiment of the present disclosure. In a main body of the image forming apparatus 100 (herein, a color printer), four image forming portions Pa, Pb, Pc, and Pd are disposed in order from an upstream side in a conveyance direction (a left side in FIG. 1). The image forming portions Pa to Pd are provided correspondingly to images of four different colors (yellow, cyan, magenta, and black), respectively, and sequentially form images of yellow, cyan, magenta, and black, respectively, by individually performing steps of charging, exposure, development, and transfer.

In the image forming portions Pa to Pd, photosensitive drums (image carrying members) 1*a*, 1*b*, 1*c*, and 1*d* are disposed, respectively, to carry visible images (toner images) of the respective colors. Moreover, an intermediate transfer belt (an intermediate transfer member) 8 that is driven by a belt drive motor (not shown) to rotate in a counterclockwise direction in FIG. 1 is provided adjacently to the image forming portions Pa to Pd. Toner images formed respectively on the photosensitive drums 1*a* to 1*d* are sequentially and primarily transferred in a superimposed manner on the intermediate transfer belt 8 moving while abutting on the photosensitive drums 1*a* to 1*d*. After that, the toner images thus primarily transferred on the intermediate transfer belt 8 are secondarily transferred by a secondary transfer roller 9 on a transfer sheet P as an example of a recording median. Moreover, the toner images secondarily transferred to the transfer sheet P are fixed thereon in a fixing portion 13, and then the transfer sheet P is discharged from the main body of the image forming apparatus 100. An image forming process with respect to the photosensitive drums 1*a* to 1*d* is executed while the photosensitive drums 1*a* to 1*d* are rotated in a clockwise direction in FIG. 1.

The transfer sheet P on which toner images are to be secondarily transferred is housed in a sheet cassette 16 arranged in a lower part of the main body of the image forming apparatus 100, The transfer sheet P is conveyed to a nip between the secondary transfer roller 9 and a driving roller 11 of the intermediate transfer belt 8 via a paper feed roller 12*a* and a registration roller pair 12*b*. As the intermediate transfer belt 8, a seam-free (seamless) belt formed of a dielectric resin sheet is mainly used. Furthermore, a blade-shaped belt cleaner 19 for removing a residual toner or the like remaining on a surface of the intermediate transfer belt 8 is arranged on a downstream side of the secondary transfer roller 9.

Next, a description is given of the image forming portions Pa to Pd. Charging devices 2*a*, 2*b*, 2*c*, and 2*d* that charge the photosensitive drums 1*a* to 1*d*, respectively, an exposure device 5 that performs exposure based on image information with respect to the photosensitive drums 1*a* to 1*d*, developing devices 3*a*, 3*b*, 3*c*, and 3*d* that form toner images on the photosensitive drums 1*a* to 1*d*, respectively, and cleaning devices 7*a*, 7*b*, 7*c*, and 7*d* that remove a residual developer (toner) or the like remaining on the photosensitive drums 1*a* to 1*d*, respectively, are provided around and below the photosensitive drums 1*a* to 1*d* rotatably disposed.

Upon image data being inputted from a host apparatus such as a personal computer, first, surfaces of the photosensitive drums 1*a* to 1*d* are uniformly charged by the charging devices 2*a* to 2*d*, respectively. Then, by the exposure device 5, light is applied thereto so as to correspond to image data so that electrostatic latent images corresponding to the image data are formed on the photosensitive drums 1*a* to 1*d*, respectively. The developing devices 3*a* to 3*d* are filled with prescribed amounts of two-component developers including toners of yellow, cyan, magenta, and black, respectively. In a case where a percentage of the toners in the two-component developers filled in the developing devices 3*a* to 3*d* falls below a preset value due to after-mentioned toner image formation, the developing devices 3*a* to 3*d* are replenished with fresh supplies of toilers from toner containers 4*a* to 4*d*, respectively. The toners in the developers are supplied onto the photosensitive drums 1*a* to 1*d* by the developing devices 3*a* to 3*d*, respectively, and electrostatically adheres thereto. Thus, there are formed toner images corresponding to the electrostatic latent images formed by exposure from the exposure device 5.

Further, by primary transfer rollers 6*a* to 6*d*, an electric field is applied at a prescribed transfer voltage between themselves and the photosensitive drums 1*a* to 1*d*, respectively, Thus, the toner images of yellow, magenta, cyan, and black on the photosensitive drums 1*a* to 1*d* are primarily transferred on the intermediate transfer belt 8. These images are formed in a prescribed positional relationship. After that, a residual toner or the like remaining on the surfaces of the photosensitive drums 1*a* to 1*d* after primary transfer is removed by the cleaning devices 7*a* to 7*d*, respectively, in preparation for subsequent formation of new electrostatic latent images.

The intermediate transfer belt 8 is stretched over a driven roller 10 on an upstream side and the driving roller 11 on a downstream side. As the driving roller 11 is driven to rotate by the belt drive motor (not shown), the intermediate transfer belt 8 starts to rotate in the counterclockwise direction, and then the transfer sheet P is conveyed at prescribed timing from the registration roller pair 12*b* to the nip (a secondary transfer nip) between the driving roller 11 and the secondary transfer roller 9 provided adjacently thereto, where the toner images on the intermediate transfer belt 8 are secondarily transferred on the transfer sheet P. The transfer sheet P on which the toner images have been secondarily transferred is conveyed to the fixing portion 13.

The transfer sheet P conveyed to the fixing portion 13 is heated and pressed by a fixing roller pair 13*a*, and thus the toner images are fixed on a surface of the transfer sheet P to form a prescribed full-color image thereon. A conveyance direction of the transfer sheet P on which the full-color image has been formed is controlled by a branch portion 14 branching off in a plurality of directions, and the transfer sheet P is directly (or after being conveyed to a double-sided conveyance path 18 and subjected to double-sided image formation therein) discharged to a discharge tray 17 by a discharge roller pair 15.

On the downstream side of the image forming portion 1*d*, at a position opposite the intermediate transfer belt 8, an image density sensor 40 is arranged. Typically used as the image density sensor 40 is an optical sensor including a light-emitting element such as an LED and a light-receiving element such as a photodiode. In measuring the amount of toner attached on the intermediate transfer belt 8, shining measurement light from the light-emitting element onto reference images formed on the intermediate transfer belt 8 results in the measurement light entering the light-receiving element as light reflected from the toner and light reflect from the belt surface.

The light reflected from the toner and the belt surface contains regularly and irregularly reflected light. The regularly and irregularly reflected light are separated from each other by a polarizing splitting prism, and then strike separate light-receiving elements respectively. The light-receiving elements perform photoelectric conversion on the received regularly and irregularly reflected light to feed output signals to a control portion (not shown). Based on changes in the characteristics of the output signals corresponding to the regularly and irregularly reflected light, the amount of toner is sensed, which is then compared with a previously determined reference density to adjust the characteristic values of a developing voltage or the like and thereby perform density correction (calibration).

Figure 2:
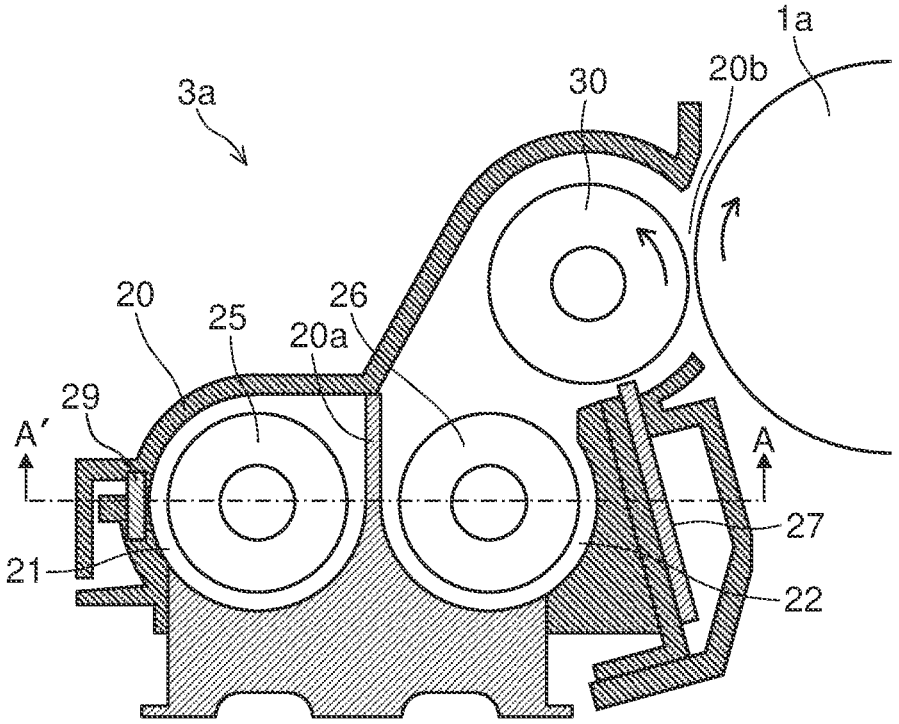
FIG. 2 is a side sectional view of a developing device according to one embodiment of the present disclosure.

FIG. 2 is a side sectional view of the developing device 3*a* mounted in the image forming apparatus 100. While the following exemplarily describes the developing device 3*a* arranged in the image forming portion Pa shown in FIG. 1, the developing devices 3*b* to 3*d* arranged in the image forming portions Pb to Pd, respectively, basically have a similar configuration to that of the developing device 3*a*, and thus descriptions thereof are omitted.

As shown in FIG. 2, the developing device 3*a* includes the developing container 20 for containing a two-component developer (hereinafter, simply referred to also as a developer) including a magnetic carrier and a toner. The developing container 20 is divided by a partition wall 20*a* into a stirring conveyance chamber 21 and a supply conveyance chamber 22. In the stirring conveyance chamber 21 and the supply conveyance chamber 22, a stirring conveyance screw 25 and a supply conveyance screw 26 for making a mixture of a toner supplied from the toner container 4*a* (see FIG. 1) and a magnetic carrier, stirring the mixture, and charging the toner are rotatably disposed, respectively. This embodiment uses a two-component developer composed of a positively chargeable toner and a ferrite/resin-coated carrier. Detailed configurations of the toner and the carrier will be described later.

Figure 3:
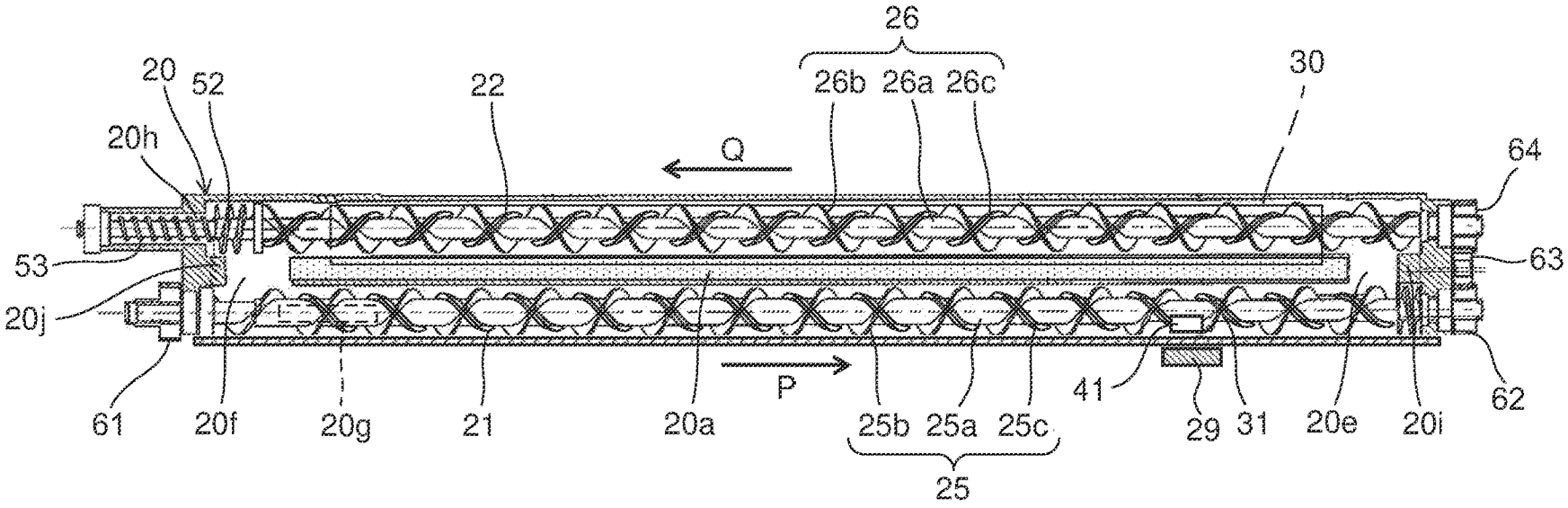
FIG. 3 is a sectional plan view of a stirring portion in the developing device.

Further, the developer is conveyed while being stirred by the stirring conveyance screw 25 and the supply conveyance screw 26 in an axis direction thereof (a direction perpendicular to a plane on which FIG. 3 is drawn) and circulates between the stirring conveyance chamber 21 and the supply conveyance chamber 22 via an upstream communication portion 20*e* and a downstream communication portion 20*f* (see FIG. 3) formed at the both ends of the partition wall 20*a*. That is, in the developing container 20, a circulation route of the developer is formed by the stirring conveyance chamber 21, the upstream communication portion 20*e*, the supply conveyance chamber 22, and the downstream communication portion 20*f*.

The developing container 20 extends to a diagonally upper right side in FIG. 2, and a developing roller 30 is arranged on a diagonally upper right side of the supply conveyance screw 26 in the developing container 20. Further, a part of an outer circumferential surface of the developing roller 30 is exposed through an opening 20*b* of the developing container 20 and is opposed at a prescribed distance (a development gap) to the photosensitive drum 1*a*. The developing roller 30 rotates (performs trail rotation at a position opposed to the photosensitive drum 1*a*) in a counterclockwise direction in FIG. 3.

The developing roller 30 is composed of a cylindrical developing sleeve that rotates in the counterclockwise direction in FIG. 2 and a magnet (not shown) that is secured in the developing sleeve 31 and that has a plurality of magnetic poles. While the developing sleeve used here is a developing sleeve having a knurled surface, it is also possible to use a developing sleeve having a surface with a multitude of concaves (dimples) formed therein, a developing sleeve having a blasted surface, a developing sleeve having a surface not only knurled and including concaves formed therein but also blasted, or a developing sleeve having a plated surface. By a developing voltage power supply (not shown), a developing voltage composed of a direct-current voltage Vdc and an alternating-current voltage Vac is applied to the developing roller 30.

Furthermore, a regulation blade 27 is fitted to the developing container 20 along a longitudinal direction of the developing roller 30 (a perpendicular direction to the plane on which FIG. 2 is drawn). A slight clearance (gap) is formed between a distal end of the regulation blade 27 and a surface of the developing roller 30, in this embodiment, a magnetic blade made of stainless steel (SUS430) is used as the regulation blade 27.

On a side surface of the stirring conveyance chamber 21, a toner concentration sensor 29 is arranged to be opposed to the stirring conveyance screw 25. The toner concentration sensor 29 senses the toner concentration (the mix ratio of toner to carrier in developer; T/C) in the developer in the developing container 20. As the toner concentration sensor 29, for example, a magnetic permeability sensor that senses the permeability of the two-component developer containing toner and magnetic carrier in the developing container 20. According to the toner concentration sensed by the toner concentration sensor 29, the toner in the toner container 4*a* (see FIG. 1) is, together with the carrier, supplied via a developer supply port 22*g* (see FIG. 3) into the developing container 20.

Next, the structure of a stirring portion in the developing device 3*a* will be described in detail. FIG. 3 is a sectional plan view of the stirring portion in the developing device 3*a* (a sectional view as seen from the direction indicated by arrows AA' in FIG. 2).

In the developing container 20, there are formed, as mentioned above, the stirring conveyance chamber 21, the supply conveyance chamber 22, the partition wall 20*a*, the upstream communication portion 20*e*, and the downstream communication portion 20*f*, and there are further formed a developer supply port 20*g*, a developer discharge portion 20*h*, an upstream side wall portion 20*i*, and a downstream side wall portion 20*j*. With respect to the stirring conveyance chamber 21, the left side of FIG. 3 is the upstream side, and the right side of FIG. 3 is the downstream side, With respect to the supply conveyance chamber 22, the right side of FIG. 3 is the upstream side, and the left side of FIG. 3 is the downstream side. Accordingly, the communication portions and the side wall portions are distinguished between upstream and downstream ones with reference to the supply conveyance chamber 22.

The partition wall 20*a* extends in the longitudinal direction of the developing container 20 and partitions it such that the stirring conveyance chamber 21 and the supply conveyance chamber 22 are located side by side. A right end part of the partition wall 20*a* in the longitudinal direction forms, along with an inner wall part of the upstream side wall portion 20*i*, the upstream communication portion 20*e*; a left end part of the partition wall 20*a* in the longitudinal direction forms, along with an inner wall part of the downstream side wall portion 20*j*, the downstream communication portion 20E Developer circulates in the developing container 20 by passing sequentially through the stirring conveyance chamber 21, the upstream communication portion 20*e*, the supply conveyance chamber 22, and the downstream communication portion 20*f*.

The developer supply port 20*g* is an opening through which to supply fresh toner and carrier from a toner container 4*a* (see FIG. 1) provided over the developing container 20 into the developing container 20, and is arranged on the upstream side (left side in FIG. 3) of the stirring conveyance chamber 21.

The developer discharge portion 20*h* is a part for discharging the developer that has become surplus in the stirring conveyance chamber 21 and the supply conveyance chamber 22 as a result of fresh developer being supplied, and is provided on the downstream side of the supply conveyance chamber 22 so as to be continuous with the supply conveyance chamber 22 in its longitudinal direction.

The stirring conveyance screw 25 has a rotary shall 25*a*, a first conveyance blade 25*b* that is formed in a spiral shape with a predetermined pitch in the axial direction of the rotary shaft 25*a*, and a second conveyance blade 25*c* that is formed with the same pitch as the first conveyance blade 25*b* in the axial direction of the rotary shaft 25*a* but that is wound in the opposite direction (has the opposite phase) to the first conveyance blade 25*b*. The first and second conveyance blades 25*b* and 25*c* extend up to opposite end parts of the stirring conveyance chamber 21 in the longitudinal direction so as to be opposed to the upstream and downstream communication portions 20*e* and 20E The rotary shaft 25*a* is rotatable pivoted on the upstream and downstream wall portions 20*i* and 20*j* of the developing container 20. The first and second conveyance blades 25*h* and 25*c* are molded of resin integrally with the rotary shaft 25*a*.

The supply conveyance screw 26 has a rotary shaft 26*a*, a first conveyance blade 26*b* that formed in a spiral shape with a predetermined pitch in the axial direction of the rotary shaft 26*a*, and a second conveyance blade 26*c* that is formed with the same pitch as the first conveyance blade 26*b* in the axial direction of the rotary shaft 26*a* but that is wound in the opposite direction (have the opposite phase) to the first conveyance blade 26*b*. The first conveyance blade 26*b* has the same pitch as the first conveyance blade 25*b* on the stirring conveyance screw 25 but is wound in the opposite direction (has the opposite phase) to the first conveyance blade 25*b* on the stirring conveyance screw 25. The first and second conveyance blades 26*b* and 26*c* have a length greater than the length of the developing roller 30 in the axial direction, and extend up to a position opposed to the upstream communication portion 20*e*. The rotary shaft 26*a* is arranged parallel to the rotary shaft 25*a*, and is rotatably pivoted on the upstream and downstream wall portions 20*i* and 20*j* of the developing container 20. The first and second conveyance blades 26*b* and 26*c* are so formed as to intersect with other at two intersections 31 180° apart from each other as they make one turn around the rotary shaft 26*a*.

Formed integrally with the rotary shaft 26*a* of the supply conveyance screw 26 are, in addition to the first and second conveyance blades 26*b* and 26*c*, a regulating portion 52, a discharge blade 53, and a disc 55. Moreover, on the stirring conveyance screw 25, to a part of it opposed to the toner concentration sensor 29, a scraper 41 is fitted. The scraper 41 is fixed to a scraper fixing portion (not shown) formed integrally with the rotary shaft 25*a*. The structure of the scraper 41 will be described in detail later.

The regulating portion 52 blocks the developer conveyed downstream in the supply conveyance chamber 22, and also conveys the part of the developer that has exceeded a predetermined amount to the developer discharge portion 20*h*. The regulating portion 52 is constituted by a spiral blade that is wound in the opposite direction (has the opposite phase) to the first conveyance blade 26*b* provided on the rotary shaft 26*a*, has an outer diameter approximately equal to that of the first conveyance blade 26*b*, and has a pitch smaller than the first conveyance blade 26*h*. Moreover, between an inner wall part, such as the downstream side wall portion 20*j*, of the developing container 20 and an outer circumferential part of the regulating portion 52, a predetermined gap is formed. Through this gap, surplus developer is discharged into the developer discharge portion 20*h*.

The rotary shall 26*a* extends into the developer discharge portion 20*h*. Inside the developer discharge portion 20*h*, the rotary shaft 26*a* is provided with the discharge blade 53. The discharge blade 53 is constituted by a spiral blade that is wound in the same direction (has the same phase) as the first conveyance blade 26*b*, but has a smaller pitch and a smaller outer diameter than the first conveyance blade 26*b*. Accordingly, as the rotary shaft 26*a* rotates, the discharge blade 53 rotates together; thus the surplus developer conveyed over the regulating portion 52 into the developer discharge portion 20*h* is conveyed leftward in FIG. 3, and is discharged via the developer discharge port (not shown) out of the developing container 20.

On the outer wall of the developing container 20, gears 61 to 64 are arranged. The gears 61 and 62 are fixed to the rotary shaft 25*a*, the gear 64 is fixed to the rotary shaft 26*a*, and the gear 63 is rotatably held on the developing container 20 and meshes with the gears 62 and 64.

As the gear 61 rotates by being driven by a development drive motor (not shown), the stirring conveyance screw 25 rotates. The developer in the stirring conveyance chamber 21 is conveyed in the main conveyance direction (a first direction, the arrow P direction) by the first conveyance blade 25*b*, and is then conveyed through the upstream communication portion 20*e* into the supply conveyance chamber 22. Moreover, as the supply conveyance screw 26 rotates via the gears 62 to 64, the developer in the supply conveyance chamber 22 is conveyed in the main conveyance direction (a second direction, the arrow Q direction) by the first conveyance blade 26*b*. During development with no fresh developer being supplied, the developer is conveyed, while greatly varying its height, from the stirring conveyance chamber 21 via the upstream communication portion 20*e* into the supply conveyance chamber 22, and is conveyed, without passing over the regulating portion 52, via the downstream communication portion 20*f* into the stirring conveyance chamber 21.

As described above, developer is stirred while it is circulating from the stirring conveyance chamber 21 to the upstream communication portion 20*e* to the supply conveyance chamber 22 and to the downstream communication portion 20*f*, so that the stirred developer is supplied to the developing roller 30.

Next, a description will be given of a case where developer is supplied via the developer supply port 20*g*. As toner is consumed in development, developer containing toner and carrier is supplied from the toner container 4*a* via the developer supply port 20*g* into the stirring conveyance chamber 21.

As during development, the supplied developer is conveyed in the stirring conveyance chamber 21 in the main conveyance direction (the arrow P direction) by the stirring conveyance screw 25, and is then conveyed via the upstream communication portion 20*e* into the supply conveyance chamber 22. The developer is then conveyed in the supply conveyance chamber 22 in the main conveyance direction (the arrow Q direction) by the supply conveyance screw 26. As the rotary shaft 26*a* rotates and as a result the regulating portion 52 rotates, the regulating portion 52 applies to the developer a conveyance force in the opposite direction (reverse conveyance direction) to the main conveyance direction. The regulating portion 52 blocks the developer and raises its height, and the surplus developer (the same amount as that supplied via the developer supply port 20*g*) moves over the regulating portion 52 so as to be discharged via the developer discharge portion 20*h* out of the developing container 20.

The conveyance force with which the developer is conveyed in the main conveyance direction (the arrow Q direction) by the first conveyance blade 26*b* is momentarily weakened by the blocking by the disc 55. The regulating portion 52 then exerts a reverse conveyance force to the developer, which is thus pushed back in the opposite direction to the main conveyance direction. That is, the disc 55 serves to reduce the conveyance force (pressure) that acts on the developer passing from the supply conveyance chamber 22 toward the regulating portion 52. This reduces ruffling (variation) of the surface of the developer moving toward the regulating portion 52 and the downstream communication portion 20*f*, and permits an approximately fixed amount of developer to stagnate near the regulating portion 52 irrespective of the conveyance speed of the developer.

When developer is supplied via the developer supply port 20*g* and the height of the developer in the developing container 20 rises, the developer stagnating on the upstream side of the regulating portion 52 moves over the disc 55 and the regulating portion 52 to the discharge blade 53 (developer discharge portion 20*h*), so that surplus developer is discharged from the developer discharge portion 20*h*. When developer ceases to be discharged from the developer discharge portion 20*h*, the height of the developer in the developing container 20 stabilizes. The volume of developer with its height stabilized is taken as the stable volume.

With the stirring conveyance screw 25 structured as described above, the first conveyance blade 25*b* is provided on the outer circumferential surface of the rotary shaft 25*a* and, as the rotary shaft 25*a* rotates, the first conveyance blade 25*b* conveys, while stirring, developer in the first direction (the arrow P direction in FIG. 3). On the outer circumferential surface of the rotary shaft 25*a*, within a pitch interval (between one turn of the blade to the next) of the first conveyance blade 25*b*, the second conveyance blade 25*c* is provided that has the opposite phase to, and a smaller diameter than, the first conveyance blade 25*b*. As the rotary shaft 25*a* rotates, the second conveyance blade 25*c* exerts to the developer a conveying effect in the second direction (the arrow Q direction) with is the opposite direction to the first direction.

Moreover, with the supply conveyance screw 26 structured as described above, the first conveyance blade 26*h* is provided on the outer circumferential surface of the rotary shaft 26*a* and, as the rotary shaft 26*a* rotates, the first conveyance blade 26*h* conveys, while stirring, the developer in the second direction (the arrow Q direction in FIG. 3). On the outer circumferential surface of the rotary shaft 26*a*, within a pitch interval (between one turn of the blade to the next), the second conveyance blade 26*c* is provided that has the opposite phase to, and a smaller diameter than, the first conveyance blade 26*b*. As the rotary shaft 26*a* rotates, the second conveyance blade 26*c* exerts to the developer a conveying effect in the first direction (the arrow P direction) that is the opposite direction to the second direction.

The second conveyance blades 25*c* and 26*c* are located, in the radial direction, inward of the outer peripheral edges of the first conveyance blades 25*b* and 26*b*. Thus, the conveying effect in the opposite direction produced by the rotation of the second conveyance blades 25*c* and 26*c* acts on part of the developer present near the rotation shafts 25*a* and 26*a*. It thus does not hamper the conveying effect by the first conveyance blades 25*b* and 26*b* in the first and second directions.

As described above, using the second conveyance blades 25*c* and 26*c*, a conveying effect is produced in the opposite direction to the conveyance direction (main conveyance direction) of developer by the first conveyance blades 25*b* and 26*b*, This causes the developer to circulate within the pitch intervals of the first conveyance blades 25*b* and 26*b*, and promotes the stirring of the developer between the first conveyance blades 25*h* and 26*b* without hampering the powder (developer) conveying effect by the first conveyance blades 25*b* and 26*b*. It is thus possible to speedily and sufficiently stir the fresh toner and carrier supplied via the developer supply port 20*g* with the two-component developer in the stirring conveyance chamber 21 and the supply conveyance chamber 22, and to effectively prevent a drop in the developer conveyance speed in the stirring conveyance chamber 21 and the supply conveyance chamber 22.

Figure 4:
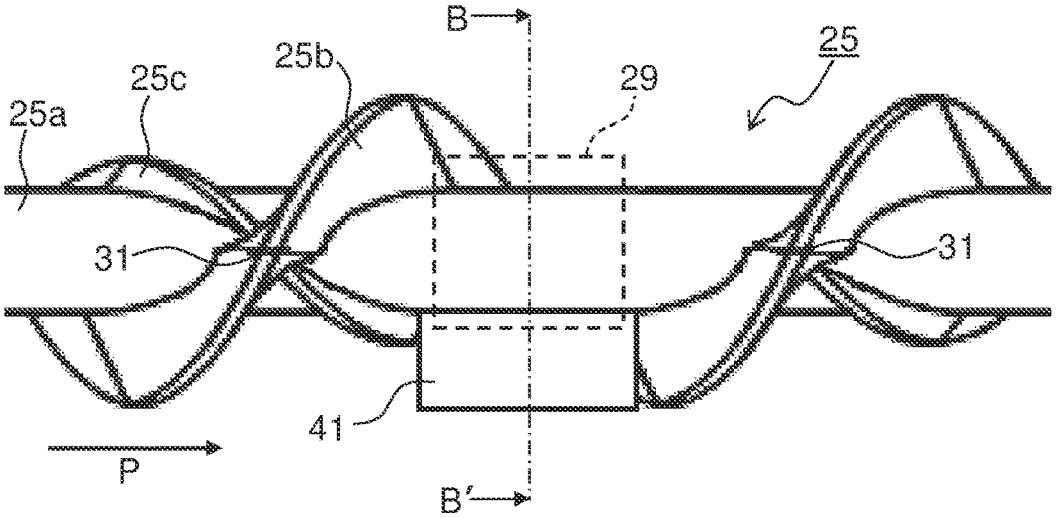
FIG. 4 is a side view around a scraper on the stirring conveyance screw used in the developing device according to the embodiment.
Figure 5:
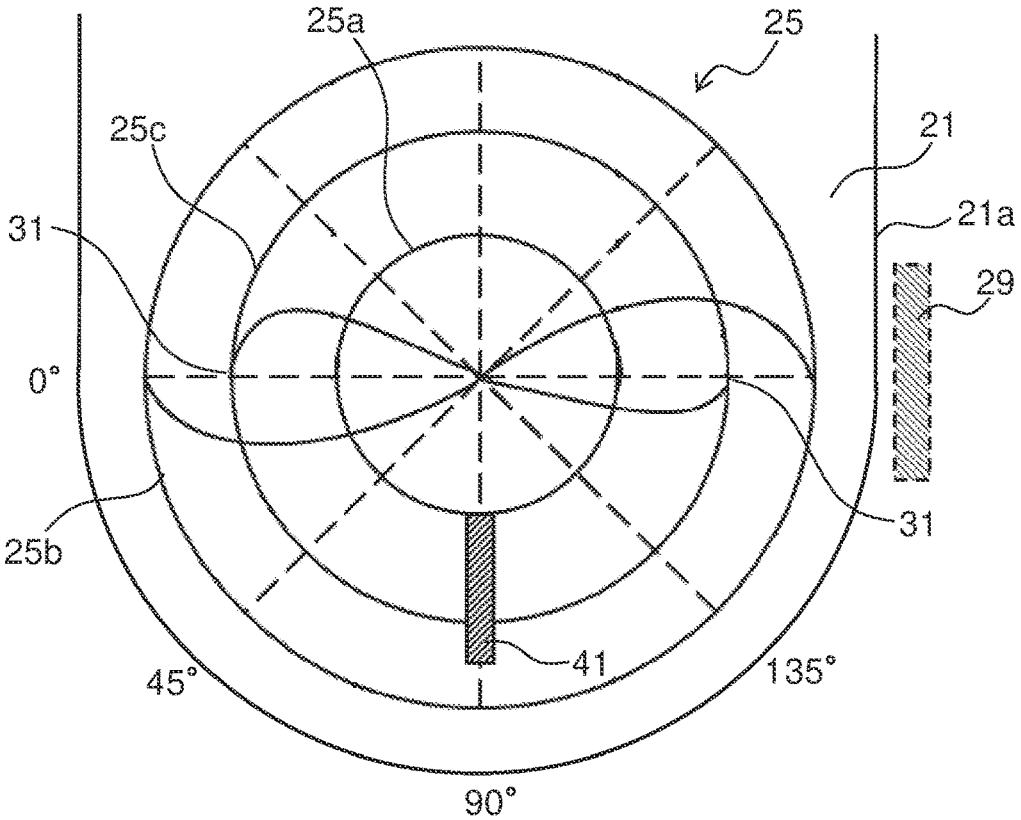
FIG. 5 is a sectional view, as cut in a radial direction, around a scraper on the stirring conveyance screw used in the developing device according to the embodiment.

FIG. 4 is a side view around the scraper 41 on the stirring conveyance screw 25 used in the developing device 3*a* according to the embodiment, and FIG. 5 is a sectional view, as cut in the radial direction (as seen from the direction of arrows BB' in FIG. 4), around the scraper 41 on the stirring conveyance screw 25 used in the developing device 3*a* according to the embodiment. As shown in FIGS. 4 and 5, the scraper 41 is formed at a position where it does not overlap, in the axial direction, the intersections 31 between the first and second conveyance blades 25*b* and 25*c*. More specifically, the scraper 41 is fitted to the rotary shaft 25*a* substantially parallel to it, at a position 90° apart in phase from the intersections 31 (positions at an angle of 0° in FIG. 5) between the first and second conveyance blades 25*b* and 25*c*.

As the rotary shaft 25*a* rotates and as a result the scraper 41 rotates, a tip part 40*a* of the scraper 41 moves developer near the sensing surface (the surface opposite the stirring conveyance screw 25) of the toner concentration sensor 29, and fresh developer is brought in. Used as the scraper 41 is, for example, a piece of a flexible film such as PET film as a base member that has a sheet of fabric such as felt or non-woven cloth laid over the downstream-side surface of the base member with respect to the rotation direction.

As mentioned above, the stirring conveyance screw 25 having the first and second conveyance blades 25*b* and 25*c* on it has the function of dispersing developer with the second conveyance blade 25*c*, and promotes the stirring of developer. Near the intersections 31 between the first and second conveyance blades 25*b* and 25*c*, however, developer tends to circulate and thus tends to be compressed to cause an increase in the developer density. Thus, if the scraper 41 is arranged to overlap the intersections 31, compressed developer causes an increase in the carrier density near the scraper 41, leading to the toner concentration sensor sensing the toner concentration to be lower than it actually is.

To avoid that, according to the embodiment, the scraper 41 is arranged al a position (phase) shifted, in the axial direction, from the intersections 31 between the first and second conveyance blades 25*b* and 25*c*. With this structure, there is no intersection 31 at the place where the scraper 41 is provided, and this helps suppress a rise in the developer density resulting from circulation of developer. This also suppresses a rise in the carrier density resulting from compression of developer, and this helps make the result of sensing by the toner concentration sensor 29 closer to the actual toner concentration. It is thus possible to effectively suppress image fogging resulting from excessive supply of toner. As will be described in connection with Practical Example 1 described below, by giving the scraper 41 a phase of 45° to 135° with respect to the intersection 31 located closest on the upstream side in the developer conveyance direction (first direction) in the stirring conveyance chamber 21, it is possible to suppress variation of the toner concentration.

If the position of the scraper 41 is too far from the intersection 31, an increased amount of developer passes through the gap between the first and second conveyance blades 25*b* and 25*c* and the scraper 41 to around the scraper 41, and this may lower the sensing accuracy of the conveyance direction and cause image fogging, That is, there is an adequate range for the positional relationship (phase) between the intersection 31 and the scraper 41. As will be described in connection with Practical Example 1, giving a phase of 45° to 90° with respect to the intersection 31 located closest on the upstream side in the developer conveyance direction (the arrow P direction), it is possible to effectively suppress variation in the toner concentration and occurrence of image fogging.

Next, the arrangement of the toner concentration sensor 29 will be described. Evenly dispersing the fresh toner supplied via the developer supply port 20*g* in the developer in the developing container 20 helps stabilize the amount of electric charge of toner. By arranging the toner concentration sensor 29 and the scraper 41, as seen from the upstream side (left side in FIG. 3) in the developer conveyance direction in the stirring conveyance chamber 21, on the downstream side of three fourths of the axial-direction length of the stirring conveyance screw 25, it is possible to sense the toner concentration with the supplied toner evenly dispersed in the developer in the stirring conveyance chamber 21.

On the other hand, in the upstream communication portion 20*e*, as developer is passed from the stirring conveyance chamber 21 to the supply conveyance chamber 22, the developer stagnates. At the place where developer stagnates, the stirring conveyance screw 25 exerts a weaker conveyance force (conveyance pressure) for developer, and thus the developer density tends to drop, leading to lower sensing accuracy. By arranging the toner concentration sensor 29 on the upstream side of the upstream communication portion 20*e* by one pitch of the first conveyance blade 25*b* or more, it is possible to sense the toner concentration without being affected by a drop in the conveyance pressure for the developer.

That is, by arranging the toner concentration sensor 29, as seen from the upstream side in the developer conveyance direction in the stirring conveyance chamber 21, on the downstream side of three fourths of the axial-direction length of the stirring conveyance screw 25 but on the upstream side of the upstream communication portion 20*e* by one half or more of the pitch of the first conveyance blade 25*b*, it is possible to improve the sensing accuracy of the toner concentration and to stabilize the toner concentration.

Moreover, in the embodiment, as the toner concentration sensor 29, a headless sensor is used. A headless sensor is embedded in an inner wall surface 21*a* of the stirring conveyance chamber 21, and senses the toner concentration in the developer in the stirring conveyance chamber 21 via the inner wall surface 21*a*.

Using a headless sensor as the toner concentration sensor 29 helps eliminate a step between the sensing surface and the inner wall surface 21*a* as with a conventional sensor. This eliminates variation of the density of developer at the step, and helps further improve the sensing accuracy of the toner concentration.

Next, a description will be given of the two-component developer used in the developing devices 3*a* to 3*d* according to the embodiment. The two-component developer contains toner and carrier. It is preferable that the toner concentration in the two-component developer (the weight ratio of toner to carrier. T/C) be 5 to 20 parts by mass of toner in 100 parts by mass of carrier.

[Toner]

As the toner, for example, a positively chargeable toner can be used. A positively chargeable toner, when rubbed against carrier, is charged positively (plus). Toner particles include toner base particles and, as necessary, an external additive that attaches to the surface of toner base particles. There is no particular restriction on the configuration of toner base particles. No external additive needs to be added, if unnecessary. With no external additive added, toner base particles correspond to toner particles.

The toner base particles contain a binder resin and a colorant. The toner base particles may further contain, as necessary, a release agent, a charge control agent, a magnetic powder, and the like. It is preferable that the toner base particles have a weight-average particle size of 5 to 12 μm, and more preferably 6 to 10 μm. The weight-average particle size of the toner base particles is measured on a grain size distribution analyzer (e.g., Multisizer II manufactured by Beckman Coulter). The toner base particles are produced by a well-known method such as pulverizing-and-classifying, melt granulation, spray granulation, polymerization, or the like.

When an external additive is added, to obtain toner with good flowability, it is preferable to use inorganic particles with number-average primary particle diameter of 5 nm or more but 30 nm or less. To make the external additive function as a spacer between particles and thereby obtain toner with good heat resistance and storage stability, it is preferable to use, as the external additive, resin particles with a number-average primary particle diameter of 50 nm or more but 200 nm or less. Examples of the external additive include inorganic oxides such as silica, titanium oxide, and alumina; metallic soaps such as calcium stearate; and the like. To make the external additive function fully as such while suppressing separation of the external additive from the toner base particles, it is preferable that the amount of external additive added be 1 part by mass or more but 10 parts by mass or less in 100 parts by mass of toner base particles.

The toner particles may be toner particles with no shell layer (non-capsule toner particles) or toner particles with a shell layer (capsule toner particles). Capsule toner particles include toner base particles composed of a toner core and a shell layer that coats the surface of the toner core. There is no particular restriction on the configuration of the toner core. The shell layer may be composed substantially solely of a thermosetting resin, or may be composed substantially solely of a thermoplastic resin, or may contain both a thermosetting resin and a thermoplastic resin. To obtain toner suitable for image formation, it is preferable that the toner base particles have a volume-average particle diameter (D50) of 4 μm or more but 9 μm or less.

Furthermore, the toner particles have hydrophobic silica particles and styrene-acrylic acid resin microparticles attached to the toner base particles. The hydrophobic silica particles are a charge control agent for adjusting the amount of electric charge of toner. The styrene-acrylic acid resin microparticles are a spacer for preventing silica particles from being embedded in the toner base particles. The styrene-acrylic acid resin microparticles, during long-time use, generally attach to the surface of the carrier and reduce the charging performance of the carrier, but exhibit weak adhesion to the coat layer of a silicone resin containing ferroelectric particles as will be described later, and thus do not keep accumulating on the carrier. It is presumed that, for an unclear reason, they have weak adhesion to a ferroelectric substance exposed on the surface of the coat layer and tend to come off

[Carrier]

The carrier used herein includes a carrier core that is a particle of a magnetic substance and a coat layer that is made of a silicone resin or the like and is formed on the surface of the carrier core. A silicone-based resin can be applied to form a thin coat film, thus enhancing uniformity of the coat layer. Furthermore, the smaller a thickness of the coat layer, the higher a capacitance of the coat layer, and thus an effect of the ferroelectric substance added to the coat layer becomes likely to be exerted.

The carrier can be of a varying shape from indefinite to spherical. Moreover, as the carrier, a carrier having an average particle diameter of not less than 20 μm and not more than 65 μm can be used. When having a number average particle diameter of not more than 65 μm, the carrier is increased in specific surface area and thus can carry an increased amount of the toner. Thus, a toner concentration in a magnetic brush can be maintained high, and the toner is therefore sufficiently supplied to the developing roller 30, so that a toner layer having a sufficient thickness can be formed. As a result, it is possible to cause a sufficient amount of the toner to fly from the toner layer to an electrostatic latent image on a photosensitive member, to suppress a decrease in image density, and to suppress unevenness in the image density. Furthermore, since the toner is sufficiently supplied to the developing roller 30, it becomes unlikely that a toner dropout region is formed in the toner layer of the developing roller 30, thus suppressing the occurrence of a hysteresis.

When the carrier has an average particle diameter smaller than 20 μm, there occurs carrier development in which the carrier adheres to the photosensitive drums 1*a* to 1*d*. The carrier that has adhered thereto might shift to the intermediate transfer belt 8 to cause a transfer void or move to the belt cleaner 19 to cause a cleaning failure. Furthermore, when the carrier has an average particle diameter larger than 65 μm, with the toner in the two-component developer moving from the developing roller 30 to any of the photosensitive drums 1*a* to 1*d*, a coarse magnetic brush of the two-component developer is formed to degrade image quality.

Examples of a material of the carrier core include magnetic metals such as iron, nickel, and cobalt, alloys thereof, alloys containing rare earths, soft ferrites such as hematite, magnetite, manganese-zinc-based ferrite, nickel-zinc-based ferrite, manganese-magnesium-based ferrite, and lithium-based ferrite, iron-based oxides such as copper-zinc-based ferrite, and mixtures thereof. The carrier core is produced by a known method such as sintering or atomization. Among carriers made of the above-described materials, ferrite carriers have excellent fluidity and are also chemically stable and thus are favorably used from viewpoints of enhancing image quality and prolonging service life.

As the ferroelectric substance, barium titanate particles are added to the coat layer. While hydrothermal polymerization, an oxalate method, or the like is used to produce barium titanate, barium titanate has physical properties varying depending on a production method thereof. When produced by the hydrothermal polymerization in particular, barium titanate has hollows therein and thus has a small absolute specific gravity and a sharp particle diameter distribution. As a result, compared with a case of being produced by any other production method, barium titanate produced by the hydrothermal polymerization has excellent dispersibility in a coat resin and thus can be dispersed uniformly. Accordingly, the charging performance of the carrier is also made uniform, and thus the hydrothermal polymerization is suitably used in the present disclosure.

Preferably, barium titanate has a volume average particle diameter of not less than 100 nm and not more than 500 nm. When having a particle diameter smaller than 100 nm, barium titanate is abruptly decreased in relative dielectric constant, so that an effect thereof related to the relative dielectric constant is reduced. On the other hand, when having a particle diameter of not less than 500 nm, barium titanate can hardly be uniformly dispersed in the coat layer.

When barium titanate is added in an amount of not less than 5 parts by mass with respect to a coat weight, an effect of stabilizing a charge amount starts to manifest itself, and when barium titanate is added in an amount of not less than 25 pans by mass with respect thereto, the effect of stabilizing a charge amount is more remarkably exhibited. When added in an excessively large amount, however, barium titanate can no longer be completely contained in the coat layer and might be partly liberated from the coat layer. A liberated part of the barium titanate might move to the photosensitive drums 1*a* to 1*d* and further into an edge part of a cleaning blade 42 of each of the cleaning devices 7*a* to 7*d*, resulting in causing a cleaning failure. Particularly in a method in which toners in the toner containers 4*a* to 4*d* are each mixed with a carrier and then are replenished to the developing devices 3*a* to 3*d*, respectively, a part of barium titanate liberated through use thereof is supplied to the developing devices 3*a* to 3*d* to increase a load on the cleaning blade 32. For this reason, barium titanate is added in an amount of preferably not less than 5 parts by mass and not more than 45 parts by mass and more preferably not less than 25 parts by mass and not more than 45 parts by mass.

As an electric conductor, carbon black is added to the coat layer. When the carbon black is added in an excessively large amount, a part of the carbon black liberated from the coat layer might adhere to the toner, causing color turbidity of toners of colors other than black. On the other hand, when the carbon black is added in an excessively small amount, it is unlikely that electric charge moves from the carrier to the toner, resulting in a failure to cause a smooth increase in toner charge amount. In the carrier of the present disclosure, barium titanate (the ferroelectric substance) is added to the coat layer so that a carrier resistance is decreased, and thus an amount of carbon black to be added can be reduced by an amount corresponding to a decrease in the carrier resistance.

Adding the ferroelectric substance (barium titanate) to the coat layer enhances an electric charge retaining capability of the carrier, thus enabling sufficient electric charge to be applied to the toner. Furthermore, adding the electric conductor (carbon black) to the coat layer enables smooth movement of electric charge from the carrier to the toner. Even when a toner concentration is increased to increase the number of toner particles to be charged, synergy between the above-described two additives enables electric charge to be applied to a saturation level of a charge amount of the toner particles.

In the embodiment, through adjustment of the amounts of ferroelectric substance and conducting agent added in the coat layer of the carrier and adjustment of the particle diameter and the coat layer thickness, a design that fulfills Expression (1) below is adopted. This helps stabilize the toner chargeability, and makes it possible to maintain operation with little image tugging for a long period.

$$0.73 \leq FR \times AD / \text{Shape Factor} \leq 2.10 \quad (1)$$

The shape factor in Expression (I) is a coefficient that represents the particle shape, and is defined by Expression (2) below.

Shape Factor=Measured Volume–Average Particle Diameter of Carrier/Particle Diameter of Carrier as Calculated from BET Specific Surface Area (2)

where

Particle Diameter of Carrier as Calculated from BET Specific Surface Area=6/(BET Specific Surface Area×Absolute Specific Gravity)

Too high a shape factor leads to shaving-off of the coat layer during durable printing, thereby causing the shape factor to tend to vary, leading to poor durable stability. By contrast, too low a shape factor leads to low toner chargeability, Thus, there is an adequate range for the shape factor.

The BET specific surface area is the specific surface area measured by a BET method (nitrogen absorption specific area measurement method); specifically, it is calculated from the amount of liquid nitrogen absorbed on the surface of the carrier. More specifically, for example, using an automatic specific area analyzer (Macsorb Model 1208, manufactured by Moumech) or the like, nitrogen is absorbed on the surface of a sample, and the BET specific surface area [$m^2/g$] of the sample can be measured by a fluid method (BET single-point method).

In Expression (1), FR×AD is an index that represents the carrier flowability. Too high a carrier flowability leads to reduced mixability with toner and hence reduced toner chargeability. By contrast, too low a carrier flowability leads to a reduced conveyance speed of the developer in the developing container 20; this leads to, in printing a series of images with a high print percentage, lower image density. Thus; there is an adequate range for the carrier flowability.

FR represents the carrier flowability, and is a value [s/50 g] that represents the time required for 50 g of carrier to be discharged. The amount of carrier discharged agrees with the actual behavior more when considered in terms of volume than when considered in terms of weight. Thus, in the embodiment, as the index for the carrier flowability, FR×AD is used which is FR as calibrated with the hulk specific gravity AD [$g/cm^3$] of the carrier.

FR can be measured according to "JIS (Japanese Industrial Standard) Z2502". Specifically, a metal funnel (with a cone angle of 60°; an orifice diameter of 2.5 mm, and an orifice length of 3.2 mm) is used and, with the orifice of the funnel closed, 50 g of a sample (carrier) is put in it. Subsequently, the orifice of the funnel is opened and simultaneously time starts to be counted with a stop watch and, at the moment that the carrier wholly leaves the orifice, time stops being counted. The measured time (passage time) corresponds to FR. AD can be measured according to "Metallic powders—Determination of apparent density MS-Z2504".

The carrier used in the embodiment has a high flowability; and tends to depend on the rotation of the stirring conveyance screw 25 and the supply conveyance screw 26; it is thus easily compressed at the intersections 31 between the first and second conveyance blades 25*b* and 25*c*. Thus, by combining it with the stirring conveyance screw 25 in which the intersections 31 between the first and second conveyance blades 25*b* and 25*c* do not overlap the scraper 41, it is possible to suppress compression of developer near the toner concentration sensor 29 and the scraper 41 and thereby improve the sensing accuracy of the toner concentration, it is thus possible to stabilize the toner concentration in the developing container 20.

Other than the above, the present disclosure is not limited to the foregoing embodiment and can be variously modified without departing from the spirit of the present disclosure. For example, the present disclosure is not limited to developing devices provided with a developing roller 30 as shown in FIG. 2; it may be applied to various developing devices that use a two-component developer containing toner and carrier. For example, the present disclosure can be applied equally to developing devices that are provided with a magnetic roller (toner supply roller) carrying developer on its outer circumferential surface and that supplies only the toner in the developer carried on the magnetic roller to a developing roller 30 to form a toner layer on the outer circumferential surface of the developing roller 30 and thereby develop an electrostatic latent image on a photosensitive drum.

Furthermore, the present disclosure is not limited to a tandem-type color printer as shown in FIG. 1 and is applicable also to various types of image forming apparatuses that employ the two-component development method, such as digital or analog monochrome and color copy machines, a monochrome printer, a color copier, and a facsimile machine. The following more specifically describes the effects of the present disclosure with reference to examples.

Example 1

Production of Carrier Containing Ferroelectric Particles

Production Example 1

By use of a homomixer, 500 g of a silicone resin (KR-255 produced by Shin-Etsu Chemical Co., Ltd.), 150 g of barium titanate (produced by Sakai Chemical Industry Co., Ltd.; hydrothermal synthesis method), 10 g of carbon black (Ketjenblack EC produced by Lion Corporation), and 1450 g of toluene were dispersed to prepare a coat solution. The coat solution thus obtained was sprayed using a fluidized-bed coating device over 5 kg of a carrier core (an Mn ferrite carrier having a volume average particle diameter of 34.7 μm, a saturation magnetization of 70 emu/g, and a coercive force of 8 Oe and produced by Dowa IP Creation Co., Ltd.) under heating at 200° C. so that the carrier core was coated with the coat solution. After that, the carrier core was calcined for an hour at 250° C. using an electric furnace, was cooled down, and then was crushed and classified using a sieve to prepare a carrier that included a coat layer containing 30 parts by mass of ferroelectric particles (barium titanate) and that had a volume-average particle diameter (D50) of 52.3 μm.

The volume-average particle diameters (D50) of the barium titanate and the carrier core were measured on a laser diffraction/scattering particle size distribution analyzer (LA-950, manufactured by Horiba, Ltd.).

Example 2

Effect of Scraper Arrangement on Stabilization of Toner Concentration

A study was made of the effect of varying the positional relationship of the scraper 41 with the intersections 31 between the first and second conveyance blades 25*b* and 25*c* on stabilizing the toner concentration measured by the toner concentration sensor 29. Tests proceeded as follows. Developing devices 3*a* to 3*d* as shown in FIG. 2 were loaded with the two-component developer containing carrier produced in Production Example 1, and were mounted in a test apparatus. The tests were conducted with the image forming portion Pa for cyan that included the photosensitive drum 1*a* and the developing device 3*a*.

For the tests, the following developing devices 3*a* were prepared: developing devices 3*a* in which a headless sensor (with no head) and a headed sensor (with a head), respectively, were arranged as the toner concentration sensor 29 on the downstream side of three fourths of the axial-direction length of the stirring conveyance screw 25 with respect to the developer conveyance direction (the arrow P direction) in the stirring conveyance chamber 21 but on the upstream side of the upstream communication portion 20*e* by one pitch of the first conveyance blade 25*b* or more (hereinafter referred to as the downstream side); and developing devices 3*a* in which a headless sensor (with no head) and a headed sensor (with a head), respectively, were arranged as the toner concentration sensor 29 on the upstream side of three fourths of the axial-direction length of the stirring conveyance screw 25 (hereinafter referred to as the upstream side).

The four types of developing device 3*a* described above were each fitted with a stirring conveyance screw 25 on which the phase of the scraper 41 with respect to the intersection 31 located closest on the upstream side in the developer conveyance direction were changed among 0°, 45°, 90°, and 135°, and the developing container 20 was loaded with 300 g of the developer.

Then, in a normal-temperature, normal-humidity environment (R'R environment, 23° C., 50%), a test image with a print percentage of 2% was printed continuously on 100000 sheets, and the variation of the toner concentration as sensed by the toner concentration sensor 29 and the occurrence of image fogging were evaluated. Image fogging was evaluated visually according to the following criteria: easily noticeable image fogging was evaluated as "P (Poor)", noticeable but tolerable image fogging as "F (Fair)", and hardly noticeable image fogging as "G (Good)".

Of the stirring conveyance screw 25, the first conveyance blade 25*b* had an outer diameter of 18 mm and a pitch of 30 mm, and the second conveyance blade 25*c* had an outer diameter of 12 mm and a pitch of 30 mm. The outer diameter ratio between the first and second conveyance blades 25*h* and 25*c* was 1.6.

Developing conditions were as follows. A developing roller 30 having an outer circumferential surface in which 80 rows of concaves were formed (knurled) and an outer diameter of 20 mm was used and, as the regulation blade 27 a magnetic blade made of stainless steel (SUS430) and having a thickness of 1.5 mm was used. The amount of developer conveyed by the developing roller 30 was 320 to 370 g/m$^2$, and the circumferential velocity ratio of the developing roller 30 to the photosensitive drums 1*a* to 1*d* was 1.8 (trail rotation at the opposed positions). A development voltage obtained by superimposing an alternating-current voltage having a peak-to-peak value (Vpp) of 1125 V, a frequency of 10 kHz, and a duty of 50% on a, direct-current voltage of 50 to 250 V was applied to the developing roller 30.

The photosensitive drums 1*a* to 1*d* were formed of an amorphous silicon (a-Si) photosensitive member having a relative dielectric constant of 11, a distance (a DS distance) between each of the photosensitive drums 1*a* to 1*d* and the developing roller 30 was set to 0.375±0.025 mm, and an amount of developer conveyed by the developing roller 30 was 350 g/m$^2$. A positively chargeable toner having an average particle diameter of 6.8 μm was used as a toner, and an initial toner concentration in the developer (a weight ratio of toner to carrier) was set to 6%. The results are shown in Table 1.

TABLE 1

| Sensor | | Scraper | Toner Concentration | |
|---|---|---|---|---|
| Head | Axial Position | Position [°] | Variation [%] | Fogging |
| Headed | Upstream | 0 | 1.0 | P |
| | | 45 | 0.8 | F-G |
| | | 90 | 0.7 | F-G |
| | | 135 | 0.7 | P-F |
| | Downstream | 0 | 0.6 | F |
| | | 45 | 0.4 | G |
| | | 90 | 0.4 | G |
| | | 135 | 0.5 | F |
| Headless | Upstream | 0 | 0.8 | P-F |
| | | 45 | 0.7 | F-G |
| | | 90 | 0.6 | F-G |
| | | 135 | 0.6 | F |
| | Downstream | 0 | 0.4 | F |
| | | 45 | 0.3 | G |
| | | 90 | 0.3 | G |
| | | 135 | 0.3 | F |

Table 1 reveals the following. In all developing devices 3*a*, when the phase of the scraper 41 relative to the intersection 31 was 45° to 135°, variation in the toner concentration was smaller than when the phase was 0° C. This is because, owing to no intersection 31 between the first and second conveyance blades 25*b* and 25*c* being located near the scraper 41, a rise in carrier density resulting from compression of developer was suppressed, leading to improved sensing accuracy of toner concentration. In particular, when the phase of the scraper 41 was 45° to 90°, occurrence of image fogging was further suppressed.

When the toner concentration sensor 29 was arranged on the downstream side, variation in the toner concentration was smaller than when it was arranged on the upstream side. This is because the toner supplied via the developer supply port 20*g* was dispersed evenly in the developer in the stirring conveyance chamber 21 and reached, with a stabilized toner concentration, the toner concentration sensor 29 and the scraper 41.

When a headless sensor was used as the toner concentration sensor 29, variation in the toner concentration was smaller than when a headed sensor was used. This is because, owing to a headless sensor leaving no step between the sensing surface and the inner wall surface 21*a*, no variation appeared in the density of developer at a step, resulting in improved sensing accuracy of the toner concentration.

The results above confirm the following. With a developing device 3*a* that uses a stirring conveyance screw 25 on which the phase of the scraper 41 relative to the intersection 31 between the first and second conveyance blades 25*b* and 25*c* is 45° to 135°, it is possible to stably sense the toner concentration, and to suppress image fogging. Moreover, by arranging the toner concentration sensor 29 on the downstream-side of three fourths of the axial-direction length of the stirring conveyance screw 25 but on the upstream side of the upstream communication portion 20*e* by one pitch of the first conveyance blade 25*b* or more, and in addition using a headless sensor as the toner concentration sensor 29, it is possible to more effectively suppress toner concentration variation and image fogging.

Example 3

Effect of Amount of Barium Titanate Added in Coat Layer of Carrier on Elimination of Image Fogging A study was made of the effect of varying the amount of barium titanate added in the coat layer of the carrier on eliminating image fogging. Tests proceeded as follows. While the amount of barium titanate added in the coat resin forming the coat layer was varied among 0 parts by mass (no addition), 10 parts by mass, 30 parts by mass, and 50 parts by mass, carrier was produced in a similar manner as in Practical Example 1. Using the carrier so produced, under similar image formation conditions as in Practical Example 2, image fogging was checked on a developing device 3*a* left for 48 hours in a high-temperature, high-humidity environment (HH environment, 32.5° C., 80%). Image fogging was evaluated by, while continuously printing blank sheets, counting the number of sheets required until image fogging improved to a predetermined level. The level of image fogging was evaluated visually. The results are shown in Table 2.

TABLE 2

| Amount of Barium Titanate Added [Parts] | Fogging-Disappearing Number of Sheets [Sheets] |
|---|---|
| 0 | 94 |
| 10 | 51 |
| 30 | 35 |
| 50 | 30 |

Table 2 reveals the following. The larger the amount of barium titanate added in the coat layer of the carrier, the more quickly image fogging disappears. More specifically, S parts by mass to 50 parts by mass of barium titanate added exerts an effect of improving image fogging. However, 30 parts by mass or more of barium titanate added tends to blunt and saturate the drop in the number of sheets printed until image fogging disappears. Thus, around 30 parts by mass or more of barium titanate added is considered most preferable, Though not specifically discussed here, adding barium titanate also improves toner scattering as well as image fogging.

The present disclosure is applicable to developing devices that include a toner concentration sensor that senses the concentration of toner in a two-component developer in a developing container and a scraper that rotates together with a stirring conveyance member to clean the sensing surface of the toner concentration sensor. Based on the present disclosure, it is possible to provide a developing device, and an image forming apparatus provided with one, that can accurately sense toner concentration in a developing container and that can suppress occurrence of image fogging resulting from excessive supply of toner.

What is claimed is:

1. A developing device, comprising:

a developing container that includes:

a plurality of conveyance chambers including a first conveyance chamber and a second conveyance chamber that are arranged mutually side by side;

a partition wall that divides the first conveyance chamber and the second conveyance chamber from each other along a longitudinal direction; and a communication portion that establishes communication between the first conveyance chamber and the second conveyance chamber on both end sides of the partition wall, the developing container containing a two-component developer including a carrier and a toner;

a first stirring conveyance member that conveys, while stirring, the developer present in the first conveyance chamber in a first direction;

a second stirring conveyance member that conveys, while stirring, the developer present in the second conveyance chamber in a second direction opposite to the first direction;

a developer carrying member that is rotatably supported to the developing container and carries, on a surface thereof, the developer present in the second conveyance chamber;

a toner concentration sensor that is arranged on an inner wall surface of the first conveyance chamber and senses a toner concentration in the developer; and a scraper that is fitted to the first stirring conveyance member and rotates together with the first stirring conveyance member so as to move the developer in a vicinity of the toner concentration sensor, wherein the first stirring conveyance member includes:

a rotary shaft that is rotatably supported in the developing container;

a first conveyance blade that is formed on an outer circumferential surface of the romp; shaft and is caused by rotation of the rotary shaft to convey the developer in the first direction; and a second conveyance blade that is formed on the outer circumferential surface of the rotary shaft so as to overlap with a region in which the first conveyance blade is formed, has an opposite phase to the first conveyance blade, and has a lower height than the first conveyance blade, the scraper is arranged substantially parallel to the rotary shaft at a position shifted in an axial direction from intersections between the first conveyance blade and the second conveyance blade, and the scraper has a phase of 45° to 135° with respect to a closest one of the intersections on an upstream side in the first direction.

2. The developing device according to claim 1, wherein the scraper has a phase of 45° to 90° with respect to the closest one of the intersections on the upstream side in the first direction.

3. The developing device according to claim 1, wherein the toner concentration sensor is arranged, as seen from an upstream side in a developer conveyance direction in the first conveyance chamber, on a downstream side of three fourths of an axial-direction length of the first stirring conveyance member but on an upstream side of the communication portion by one half or more of a pitch of the first conveyance blade.

4. The developing device according to claim 1, wherein the scraper is composed of a base member formed of a flexible film and a sheet of fabric laid over a downstream-side surface of the base member with respect to a rotation direction thereof.

5. The developing device according to claim 1, wherein the toner concentration sensor is a headless sensor having a sensing surface embedded in the inner wall surface of the first conveyance chamber.

6. The developing device according to claim 1, wherein the carrier includes:

a carrier core that is a particle of a magnetic substance; and a coat layer that is made of a resin and is formed on a surface of the carrier core, and the carrier fulfills Expression (1) below:

$$0.73 \leq FR \times AD/\text{Shape Factor} \leq 2.10 \quad (1)$$

where

FR denotes time [s/50 g] taken for 50 g of the carrier to be discharged,

AD denotes a bulk specific gravity [g/cm$^3$] of the carrier, and

Shape Factor equals a measured volume-average particle diameter of the carrier divided by a particle diameter of the carrier as calculated from a BET specific surface area.

7. The developing device according to claim 6, wherein:

the coat layer contains barium titanate as a ferroelectric substance, and the barium titanate is added in an amount of 5 to 45 parts by mass with respect to 100 parts by mass of a coat resin forming the coat layer.

8. The developing device according to claim 7, wherein the barium titanate is added in an amount of 25 to 45 parts by mass with respect to 100 parts by mass of the coat resin.

9. An image forming apparatus, comprising:

an image carrying member; and the developing device according to claim 1 that makes the toner adhere to an electrostatic latent image formed on the image carrying member so as to form a toner image thereon.

* * * * *